US009999563B2

(12) United States Patent
Bond

(10) Patent No.: US 9,999,563 B2
(45) Date of Patent: Jun. 19, 2018

(54) MASSAGE DEVICE

(71) Applicant: Walter David Bond, Sherman Oaks, CA (US)

(72) Inventor: Walter David Bond, Sherman Oaks, CA (US)

( * ) Notice: Subject to any disclaimer, the term of this patent is extended or adjusted under 35 U.S.C. 154(b) by 570 days.

(21) Appl. No.: 14/625,493

(22) Filed: Feb. 18, 2015

(65) Prior Publication Data

US 2016/0235617 A1 Aug. 18, 2016

(51) Int. Cl.
*A61H 7/00* (2006.01)

(52) U.S. Cl.
CPC ..... *A61H 7/003* (2013.01); *A61H 7/001* (2013.01); *A61H 2201/1253* (2013.01); *A61H 2201/165* (2013.01); *A61H 2201/1685* (2013.01); *A61H 2201/1695* (2013.01); *A61H 2205/062* (2013.01); *A61H 2205/081* (2013.01)

(58) Field of Classification Search
CPC ..... A61F 2/588; A61F 4/00; B25J 1/00; B25J 1/02; B25J 1/04; A61H 7/001; A61H 7/003
USPC ..... 623/65
See application file for complete search history.

(56) References Cited

U.S. PATENT DOCUMENTS 1,612,343 A * 12/1926 Amussen ..... A61H 7/003 601/135
2,127,674 A * 8/1938 Clarke ..... A61H 7/003 15/143.1
4,196,742 A * 4/1980 Owen, Jr. ..... A61H 3/0288 135/66
4,266,536 A * 5/1981 Casares ..... A61H 15/0092 601/119
4,574,788 A * 3/1986 Jordan ..... A61H 7/003 601/137
4,993,766 A * 2/1991 Sutherland ..... B25J 1/04 294/104
5,379,758 A * 1/1995 Snyder ..... A61B 17/02 15/143.1
D382,644 S * 8/1997 Chi ..... D24/200
D444,566 S * 7/2001 Thomas ..... D24/214
6,261,251 B1 * 7/2001 Meyers ..... A61H 7/001 601/134
6,758,826 B2 * 7/2004 Luettgen ..... A61H 19/34 601/135
8,157,664 B2 * 4/2012 Duncan ..... A61F 4/00 473/205

(Continued)

*Primary Examiner* — Justine Yu
*Assistant Examiner* — Kathrynn Lyddane
(74) *Attorney, Agent, or Firm* — Plager Schack LLP

(57) ABSTRACT

This massage device is configured to apply pressure to a human user's back, shoulders, or any distinct part of the musculoskeletal system. It can also be operated with a single arm and attaches to the user's forearm to apply pin-point or various pressure to target muscles. The massage device includes an arm plate that is configured to cover a forearm and a wrist of a human user. A hand grip is mechanically coupled to the arm plate and configured to accommodate the gripping of human fingers. A wrist bar is attached to the arm plate. A J-bar may be attached to the wrist bar. A tip is attached to the J-bar or directly to the short wrist bar. The tip is configured to provide variant pressure to the human user's back or shoulders or distal body part. Thereby duplicating mechanical pressure applied by a trained bodyworker by the untrained self at a much more reasonable price.

6 Claims, 4 Drawing Sheets

(56) References Cited

U.S. PATENT DOCUMENTS

| | | | | |
|---|---|---|---|---|
| 9,532,918 | B1 * | 1/2017 | Louis | A61H 7/003 |
| 2003/0033023 | A1 * | 2/2003 | McCrae | A47G 21/08<br>623/65 |
| 2006/0174449 | A1 * | 8/2006 | Hughes | A61F 4/00<br>16/430 |
| 2007/0287938 | A1 * | 12/2007 | Shields | A61H 15/0092<br>601/15 |
| 2009/0159487 | A1 * | 6/2009 | Tacoma | A47K 7/028<br>206/581 |
| 2013/0023807 | A1 * | 1/2013 | Hennessey | A61H 7/003<br>601/119 |

* cited by examiner

FIG.1
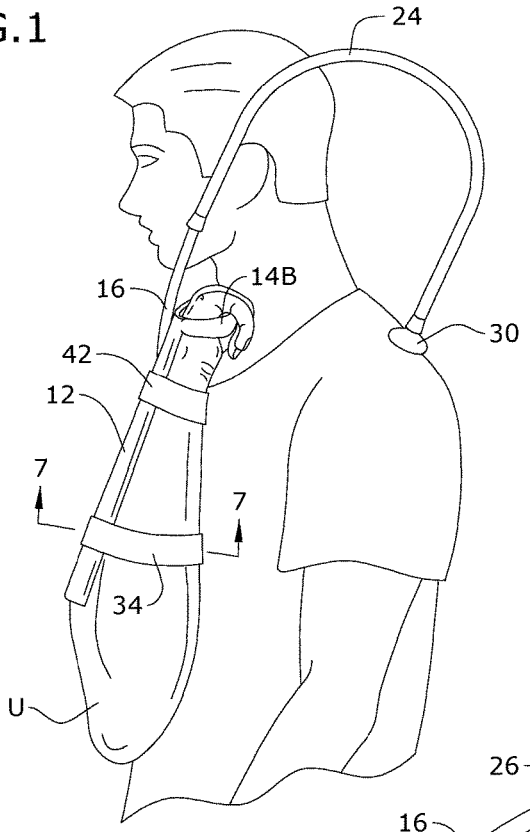
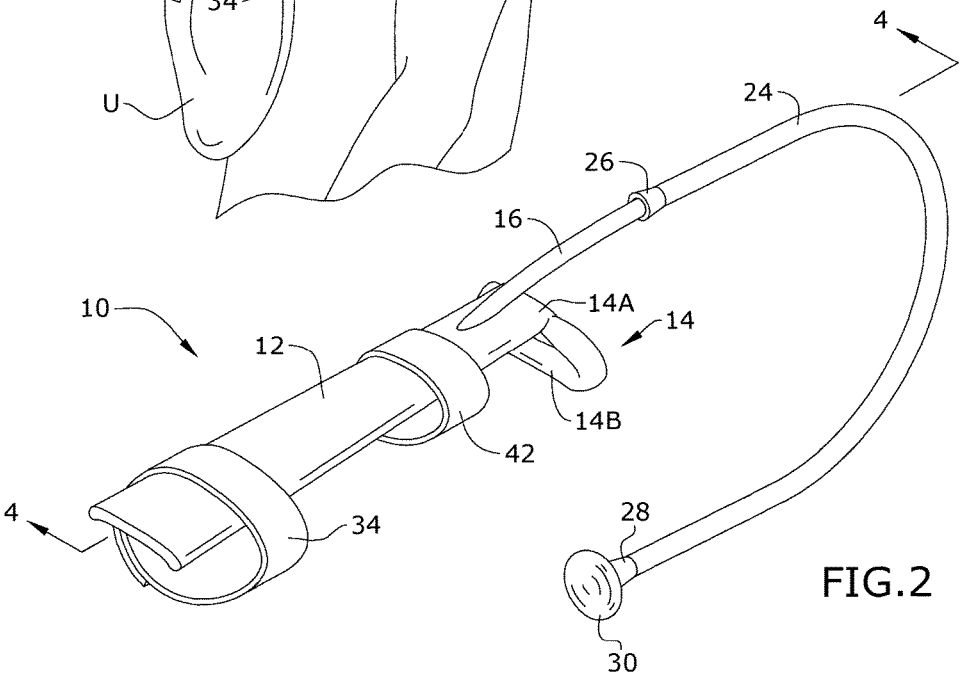
FIG.2

FIG.3
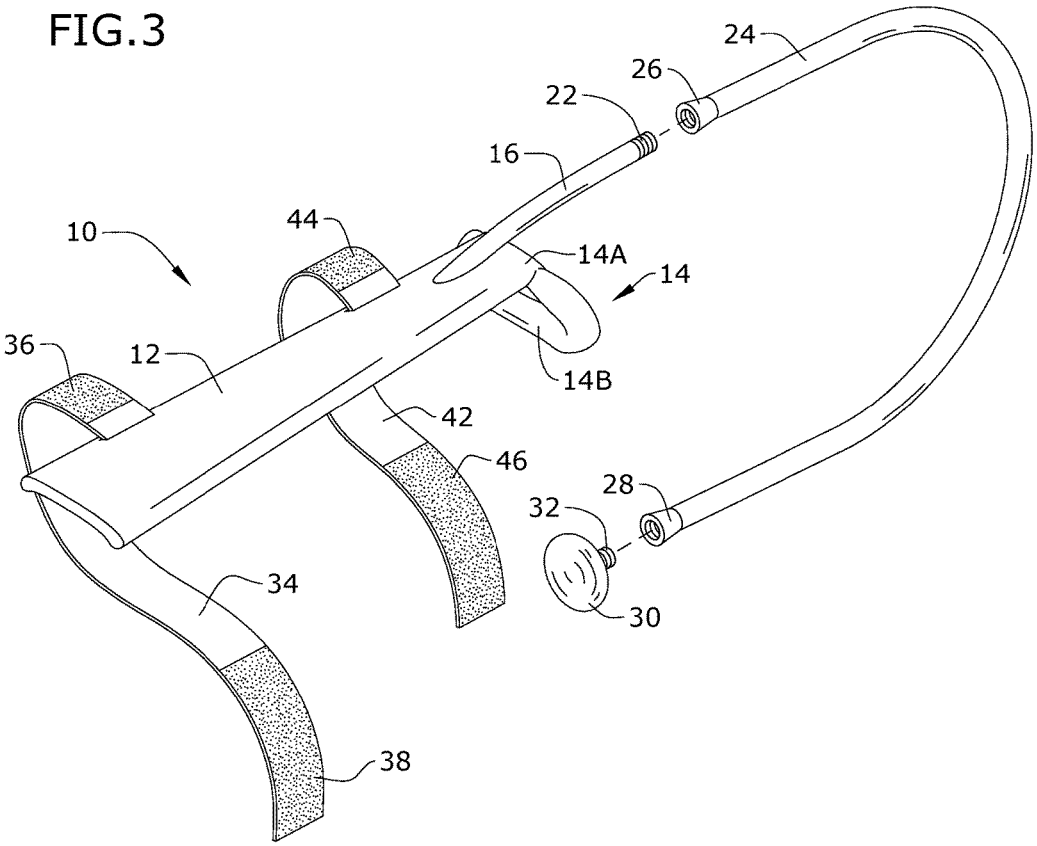
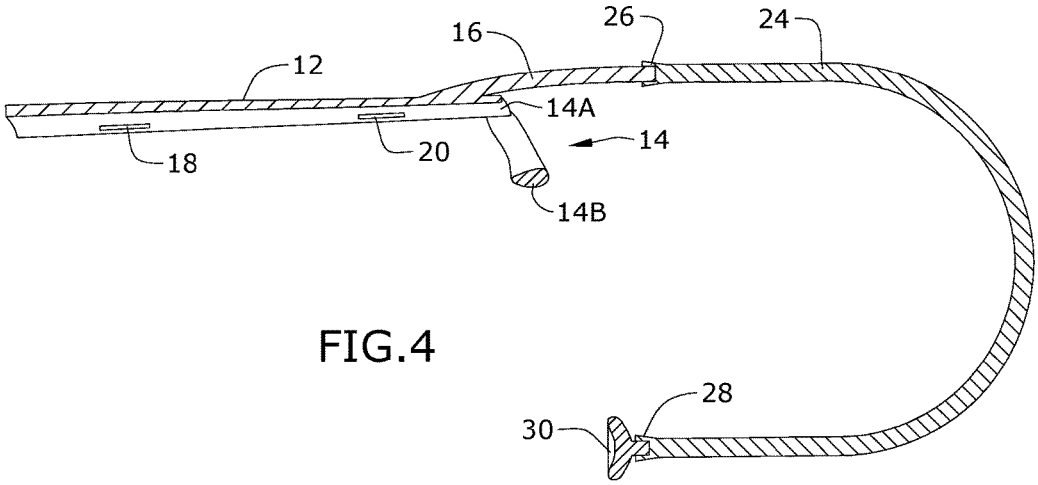
FIG.4

FIG.6
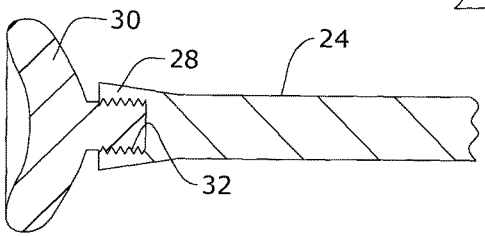
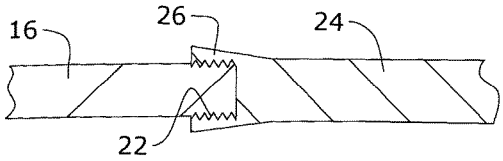
FIG.5
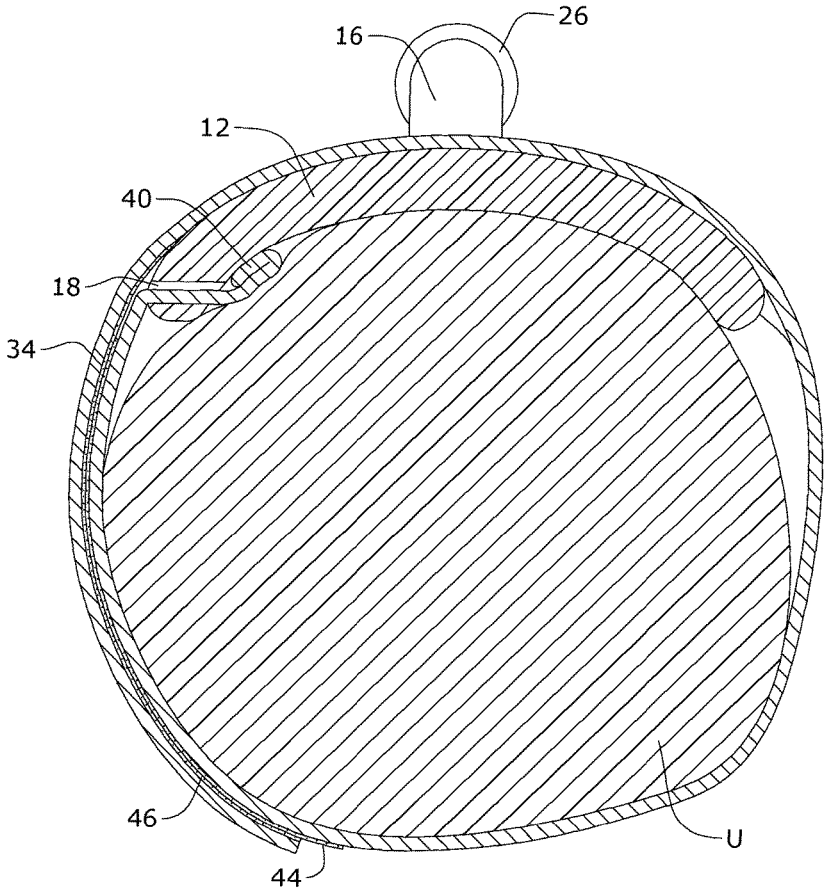
FIG.7

FIG.8
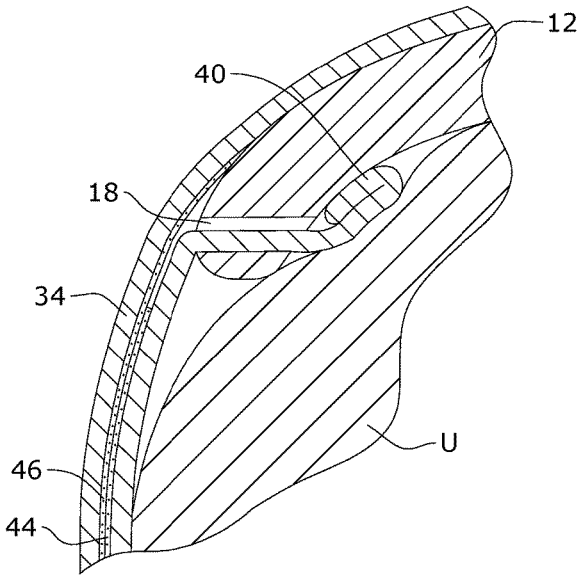
FIG.9
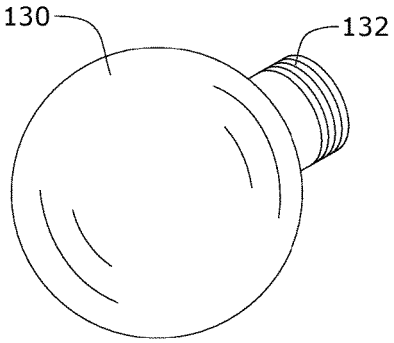
FIG.10
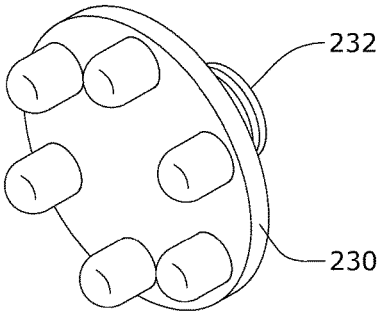
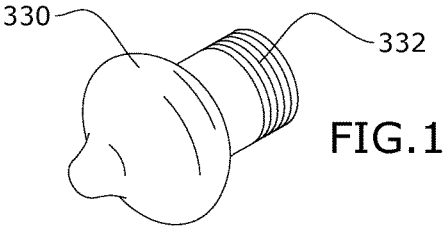
FIG.11

MASSAGE DEVICE

BACKGROUND

The embodiments herein relate generally to devices that can place pressure on a human user's back as well as other body structures such as the arms, legs, hips, neck, feet, etc. More specifically, embodiments of the invention are directed to a hand operated portable massage device worn on the operators forearm.

Prior to embodiments of the disclosed invention, mechanical hand massagers generally required two hands to operate and did not generate enough force to apply pressure on the muscle or trigger point. Embodiments of the disclosed invention solve these problems.

SUMMARY

A massage device is configured to apply mechanical pressure to hard to reach areas of a human user's musculo-skeletal system. The massage device is designed to apply meaningful force to massage or apply trigger point therapy to distant muscles of the body, be operated with a single arm and specifically attaches to the user's forearm and thus the user can pinpoint target muscle areas. The handheld massager comprising a forearm body, configured to conform generally to the shape of a user's forearm and allow the wrist to remain stable during use, wherein the forearm body has an extension body along a longitudinal axis, the extension body generally described as a J-bar (or U shaped) being sufficiently large enough and generally in a curvilinear shape and configured to wrap at least partially around the user's girth and long enough to reach the distal lower extremity and comprising a body-contacting head point, wherein the extension body is also configured to have a shape to permit the user to reach the proximal body part utilizing a short, straight arm bar. The massage device includes an arm plate that is configured in a curvilinear shape to conform and to cover a forearm and a wrist of a human user from the proximal elbow and extending to the distal hand and lined with a soft material to mold to the user's forearm. A hand grip is mechanically coupled to the arm plate and configured to accommodate human fingers and allowing the user to slide at least a portion of the user's hand through the available space and allow the user to grip the hand bar and thus be able to maintain the first member stable against the user's forearm during use. A wrist bar is attached to the arm plate. A J (or U-shaped) bar may be attached to the wrist bar. The device is useable without the J-bar as well. A tip is attached to the J-bar or the end of the arm plate short bar, which can also be interchangeable with several different tips. The tip is configured to provide meaningful massage or trigger point pressure to the human user's target area of the musculo-skeletal system.

In some embodiments, two forearm strap attachment slots can be formed within the arm plate. A forearm strap can be mechanically coupled to a forearm loop fastener, a forearm hook fastener and a forearm fold-over portion. The forearm strap can be inserted through forearm strap attachment slot until the forearm fold-over portion is immediately adjacent to the forearm strap attachment slot. The forearm strap can be wrapped around the forearm of the human user, in the proximal and distal position, so that the forearm hook fastener is joined to the forearm loop fastener and thus fastening the forearm strap onto the forearm of the human user.

In some embodiments, a wrist strap attachment slot can be formed within the arm plate. A wrist strap can be mechanically coupled to a wrist loop fastener, a wrist hook fastener and a wrist fold-over portion. The wrist strap can be inserted through wrist strap attachment slot until the wrist fold-over portion is immediately adjacent to the wrist strap attachment slot. The wrist strap can be wrapped around the wrist of the human user, so that the wrist hook fastener is joined to the wrist loop fastener and thus fastening the wrist strap onto the wrist of the human user.

In some embodiments, the tip can be selected from a set. The set includes: a scraper blade; a ball; a knobby tip; and a nipple tip. These can be applied to either the end of the short wrist bar utilizing a coupling device consisting of two female threaded tips end to end, as well as the end of the J-bar directly without a coupling device.

In some embodiments, wrist bar threads can be threaded onto the wrist bar. A wrist thread receiver can be formed within the J-bar. Threading the wrist bar threads into the wrist thread receiver joins the J-bar to the wrist bar.

In some embodiments, a tip threaded receiver can be formed within the J-bar. A tip threaded shaft can be attached to the tip. Threading the tip threaded shaft into the tip joins the J-bar to the tip.

BRIEF DESCRIPTION OF THE FIGURES

The detailed description of some embodiments of the invention is made below with reference to the accompanying figures, wherein like numerals represent corresponding parts of the figures.

FIG. 1 is a perspective view of an embodiment of the invention shown in use

FIG. 2 is a perspective view of an embodiment of the invention.

FIG. 3 is an exploded view of an embodiment of the invention.

FIG. 4 is a section view taken from 4-4 in FIG. 2 illustrated without the forearm strap for clarification.

FIG. 5 is an enlarged section view.

FIG. 6 is an enlarged section view.

FIG. 7 is a section view taken from 7-7 in FIG. 1.

FIG. 8 is an enlarged section view.

FIG. 9 is a perspective view of an embodiment of the invention.

FIG. 10 is a perspective view of an embodiment of the invention.

FIG. 11 is a perspective view of an alternate embodiment.

DETAILED DESCRIPTION OF CERTAIN EMBODIMENTS

By way of example, and referring to FIGS. 1-8, one embodiment of massage device 10 comprises arm plate 12 mechanically coupled to hand grip 14 and wrist bar 16. Hand grip further comprises hand grip upper portion 14A joined to hand grip lower portion 14B. Arm plate 12 is perforated with forearm strap attachment slot 18 and wrist strap attachment slot 20. The hand grip lower portion 14B extends distally from the arm plate 12 and the hand grip lower portion 14B is configured to accommodate human fingers. In some embodiments, the forearm body is made of aluminum in alternative embodiments, the forearm body is made of durable plastic.

As shown in FIG. 5 and FIG. 6, wrist bar 16 is threaded with wrist bar threads 22. J-bar 24 further comprises wrist thread receiver 26 and tip threaded receiver 28. A user can thread wrist bar threads 22 into wrist thread receiver 26 to join J-bar 24 to wrist bar 16. This causes J-bar 24 to bend around the hand grip 14 while distant from the hand grip upper portion 14A. Tip 30 is mechanically coupled to tip threaded shaft 32. A user can thread tip threaded shaft 32 into tip threaded receiver 28 to join J-bar 24 to tip 30. In some embodiments, the removable tips are comprised of plastic and in alternative embodiments they are comprised of aluminum. To be effective J-bar 24 must have a first parallel section joined to a first rounded section. In some embodiments, the J-bar is comprised of aluminum.

As shown in FIG. 3, FIG. 7 and FIG. 9, forearm strap 34 is mechanically coupled to forearm loop fastener 36, forearm hook fastener 38 and forearm fold-over portion 40. Forearm strap 34 is inserted through forearm strap attachment slot 18 until forearm fold-over portion 40 prevents further motion. Then, forearm strap 34 is wrapped around the forearm of user U, so that forearm hook fastener 38 is joined to forearm loop fastener 36 and thus fastening the strap onto the forearm of user U. In some embodiments the strap comprised cloth and in alternative embodiments the strap may comprise nylon.

As shown in FIG. 3, FIG. 7 and FIG. 9, wrist strap 42 is mechanically coupled to wrist loop fastener 44, wrist hook fastener 46 and a wrist fold-over portion. Wrist strap 42 is inserted through wrist strap attachment slot 20 until the wrist fold-over portion prevents further motion. Then, wrist strap 42 is wrapped around the wrist of user U, so that wrist hook fastener 44 is joined to wrist loop fastener 46 and thus fastening the strap onto the wrist of user U.

There are a series of different therapeutic techniques that require a specialized tip 30 of one variety or another. Tip 30 is shown as a scraper blade. FIGS. 9-11 show possible alternates. For instance, in FIG. 9 ball 130 is mechanically coupled to tip threaded shaft 132. In FIG. 10, knobby tip 230 is mechanically coupled to tip threaded shaft 232. In FIG. 11, nipple tip 330 is mechanically coupled to tip threaded shaft 332.

While the foregoing is directed to embodiments of the present invention, other and further embodiments of the invention may be devised without departing from the basic scope thereof. Furthermore, whereas the multitude of embodiment disclosed herein each provide a variety of elements within each embodiment, it should be appreciated any combination of elements from any combination of embodiments is well within the scope of further embodiments of the present invention.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A massage device, configured to apply pressure to a human user's back or shoulders or other bodily part of the muscular-skeletal system using a single arm; the massage device comprising:

an arm plate, configured to cover a forearm and a wrist of a human user;

a hand grip, having a hand grip upper portion and a hand grip lower portion, wherein the hand grip upper portion is directly attached to a distal end of the arm plate such that the hand grip lower portion extends distally from the arm plate and the hand grip lower portion is configured to accommodate human fingers;

a wrist bar, attached to the arm plate proximate the distal end and extending distally over the hand grip upper portion;

a J-bar, attached to a wrist bar distal end and bending around the hand grip while distant from the hand grip upper portion;

a tip, mechanically coupled to the J-bar;

wherein the tip is configured to provide the pressure to the human user's back or shoulders.

2. The massage device of claim 1, further comprising:

a forearm strap attachment slot formed within the arm plate;

a forearm strap, mechanically coupled to a forearm loop fastener, a forearm hook fastener and a forearm fold-over portion;

wherein the forearm strap is inserted through forearm strap attachment slot until the forearm fold-over portion is immediately adjacent to the forearm strap attachment slot;

wherein the forearm strap is configured to be wrapped around the forearm of the human user, so that the forearm hook fastener is joined to the forearm loop fastener and thus fastening the forearm strap onto the forearm of the human user.

3. The massage device of claim 2, further comprising:

a wrist strap attachment slot formed within the arm plate;

a wrist strap, mechanically coupled to a wrist loop fastener, a wrist hook fastener and a wrist fold-over portion;

wherein the wrist strap is inserted through wrist strap attachment slot until the wrist fold-over portion is immediately adjacent to the wrist strap attachment slot;

wherein the wrist strap is configured to be wrapped around the wrist of the human user, so that the wrist hook fastener is joined to the wrist loop fastener and thus fastening the wrist strap onto the wrist of the human user.

4. The massage device of claim 1, wherein the tip is selected from the set consisting of: a scraper blade; a ball; a knobby tip; and a nipple tip.

5. The massage device of claim 1, further comprising:

wrist bar threads threaded onto the wrist bar; and a wrist thread receiver formed within the J-bar;

wherein threading the wrist bar threads into the wrist thread receiver joins the J-bar to the wrist bar.

6. The massage device of claim 1, further comprising:

a tip threaded receiver formed within the J-bar;

a tip threaded shaft, attached to the tip;

wherein threading the tip threaded shaft into the tip joins the J-bar to the tip.

* * * * *